US006116073A

United States Patent [19]

Kajiwara et al.

[11] Patent Number: 6,116,073

[45] **Date of Patent: *Sep. 12, 2000**

[54] CLUSTER TYPE MULTI-ROLL ROLLING MILL AND ROLLING METHOD

[75] Inventors: Toshiyuki Kajiwara, Tokyo; Takashi Norikura, Hitachi; Kenichi Koyama, Takahagi; Hidetoshi Nishi, Hitachi, all of Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/771,931

[22] Filed: Dec. 23, 1996

[30] Foreign Application Priority Data

Dec. 21, 1995 [JP] Japan ..... 7-333010

[51] Int. Cl.[7] ..... B21B 13/14

[52] U.S. Cl. ..... 72/242.4

[58] Field of Search ..... 72/242.2, 242.4, 72/245, 241.4, 241.6

[56] References Cited

U.S. PATENT DOCUMENTS

| | | | |
|---|---|---|---|
| 2,776,586 | 1/1957 | Sendzimir . | |
| 3,422,655 | 1/1969 | Stone et al. | 72/237 |
| 3,596,489 | 8/1971 | Ball | 72/241.6 |
| 3,858,424 | 1/1975 | Kajiwara et al. | 72/242.4 |
| 4,487,044 | 12/1984 | Fapiano | 72/10.6 |
| 4,614,099 | 9/1986 | Coulter | 72/245 |
| 5,421,184 | 6/1995 | Sendzimir et al. | 72/242.4 |
| 5,471,859 | 12/1995 | Sendzimir et al. | 72/242.4 |

FOREIGN PATENT DOCUMENTS

| | | | |
|---|---|---|---|
| 42-4764 | 2/1967 | Japan | 72/242.4 |
| 54-1259 | 1/1979 | Japan . | |
| 63-132710 | 6/1988 | Japan | 72/241.4 |
| 5-337513 | 12/1993 | Japan | 72/241.4 |

*Primary Examiner*—Lowell A. Larson

*Attorney, Agent, or Firm*—Evenson, McKeown, Edwards & Lenahan, P.L.L.C.

[57] ABSTRACT

A cluster type multi-roll rolling mill with 20 rolls provided in a mono-block housing has 4 backing bearing shafts for supporting rolls on each of two, upper and lower, sides of a travelling path of a rolling material, and is characterized in that the 4 backing bearing shafts on at least one side of said two, upper and lower sides consist of two outside backing bearing shafts and two central backing bearing shafts, the two outside backing bearing shafts each are fixed to the housing through a saddle, the two central backing bearing shafts between the two outside backing bearing shafts are movable in a vertical direction and a drive mechanism is provided for moving vertically the two central backing bearing shafts.

4 Claims, 11 Drawing Sheets

CLUSTER TYPE MULTI-ROLL ROLLING MILL AND ROLLING METHOD

BACKGROUND OF THE INVENTION

The present invention relates to a cluster type multi-roll rolling mill with 20 rolls and a rolling method thereby.

Special steel represented by stainless steel is on the way to expanding in an amount of production mainly for civil requirements because of its excellent corrosion resistance. Since stainless steel has the strength 2 or 3 times as strong as the strength of plain carbon steel, rolling of its thin gauge strip is difficult by an ordinary rolling mill and a rolling mill is needed in which work rolls of minimum diameter are applicable.

A typical rolling mill in which this is realized is a cluster type 20-high sendzimir rolling mill. Although there is a 12-high sendzimir rolling mill, the 20-high sendzimir rolling mill is regularly used for stainless steel of special steel.

The construction is described in detail in U.S. Pat. No. 2,776,586. The sendzimir rolling mills in which work rolls of minimum diameter are applied have increased drastically a production amount of stainless steel strip.

Further, housings of multi-roll rolling mills are roughly classified into a mono-block housing type and a split housing type. JP A 54-1259 discloses a multi-roll rolling mill in which all 4 backing bearing shafts of a lower portion are accommodated in a common frame and moved up and down.

The 20-high sendzimir rolling mill which is a cluster type multi-roll rolling mill has large advantages, caused by a mono-block housing, one intermediate roll shift, strip crown/shape control called AS-U system. However, it has the following demerits.

(1) A roll gap between upper and lower work rolls is about 6–8 mm although it depends on the diameter of the work rolls, and it was impossible to make the gap larger.

This is because screw-down control is effected by utilizing the eccentricity of bearings supporting backing bearings. For this reason, it is not easy to pass a rolling material through the gap. Further, in case where the rolling material is broken, much labor is spent for taking out the rolling material wound therein. Irrespective of high mill stiffness, the gap between upper and lower work rolls is restricted to be small because of geometrical dimensional relations, so that uses for its rolling are restricted.

(2) Restriction in strip crown/shape control ability:

In conventional sendzimir rolling mills, since backing bearings of an AS-U system and a screw-down device are common, a shaft of backing bearings is a common mono-block shaft to the both, and the deflectability of the shaft is limited, which results in limiting of a control amount of the AS-U.

Further, since regarding the screw-down control, only simultaneous screw-down is possible, a leveling operation has to be done by the AS-U system, so that the ability of strip crown/shape control is reduced by that extent.

(3) It is impossible to measure rolling load.

Therefore, a real state of rolling operation can not be precisely taken, and a skilled art is required for precise detection of an optimum rolling condition. Further, a gauge meter system which is a useful method of automatic gauge control can not be applied.

Further, the conventional technique disclosed in JP A 54-1259 has the following disadvantages.

(1) Mill stiffness is less.

As shown in FIG. 4, a large load of about 55% of a rolling load is applied on each frame fillet portion 22 by component force 23 of the rolling load. However, since the rolling mill is not made of a mono-block housing, the frame fillet portions 22 are bulged and deformed by the above-mentioned large load to provide an opened upper portion, so that the mill stiffness decreases. The decrease in the mill stiffness decreases precision in thickness of a rolling strip.

(2) Sliding resistance increases and hysteresis at the time of screw-down also increases.

Since the upper portion of the frame is opened by the above-mentioned deflection of the frame fillet portions 22, contact pressure between the frame and the housing increases, and the sliding resistance increases. As a result, hysteresis at the time of screw-down increases and preciseness in thickness of a rolling material decreases.

SUMMARY 0F THE INVENTION

An object of the invention is to provide a cluster type multi-roll rolling mill which is excellent in mill stiffness, able to raise thickness precision of a rolling material, and able to increase a gap between upper and lower work rolls thereby making it easy to pass or thread the rolling material through the gap, and a rolling method.

A cluster type multi-roll rolling mill with 20 rolls provided in a mono-block housing according to the present invention, has 4 backing bearing shafts for supporting rolls on each of two, upper and lower, sides of a travelling path of a rolling material, and is characterized in that the 4 backing bearing shafts on at least one side of said two, upper and lower sides consist of two outside backing bearing shafts and two central backing bearing shafts, the two outside backing bearing shafts each are fixed to the housing through a saddle, the two central backing bearing shafts between the two outside backing bearing shafts are movable in a vertical direction and a drive mechanism is provided for moving vertically the two central backing bearing shafts.

A rolling method, of the present invention, by a cluster type multi-roll rolling mill with 20 rolls provided in a mono-block housing, having 4 backing bearing shafts for supporting rolls on each of two, upper and lower, sides of a travelling path of a rolling material, is characterized in that the 4 backing bearing shafts on at least one side of the two, upper and lower sides consist of two outside backing bearing shafts and two central backing bearing shafts, the two outside backing bearing shafts each are fixed to the housing through a saddle, the two central backing bearing shafts between the two outside backing bearing shafts are mounted on a frame, at least three frame drive mechanisms each are arranged in a roll-axial direction for moving vertically the frame, and at least one control of large stroke roll gap control, screw-down control, screw-down leveling control, and strip crown/shape control is effected by the at least three frame drive mechanisms.

BREIF DESCRIPTION OF THE DRAWINGS

Figure 11B:
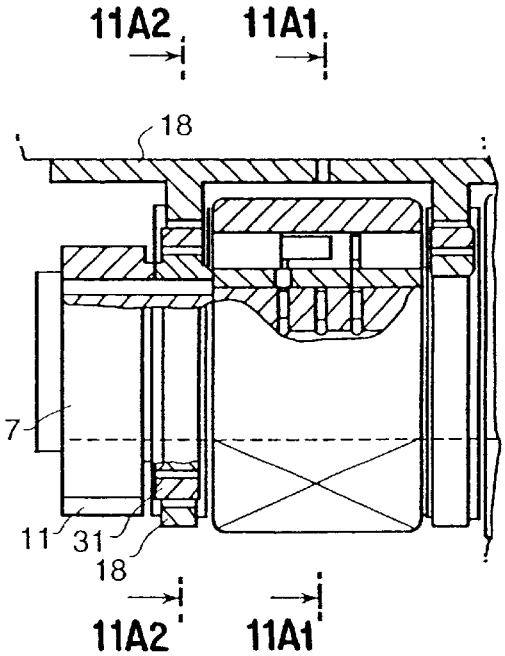
Figure 12:
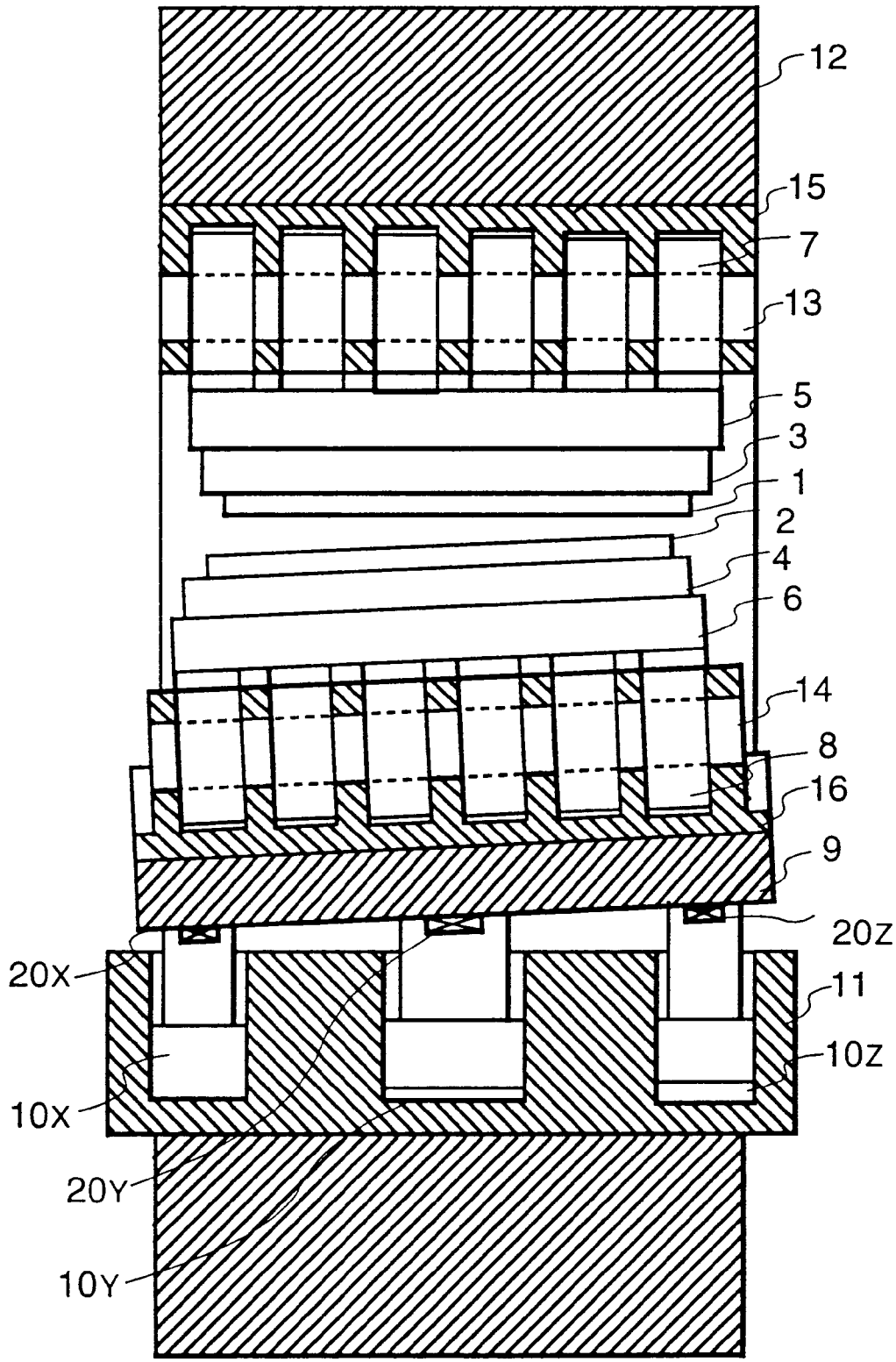
Figure 13:
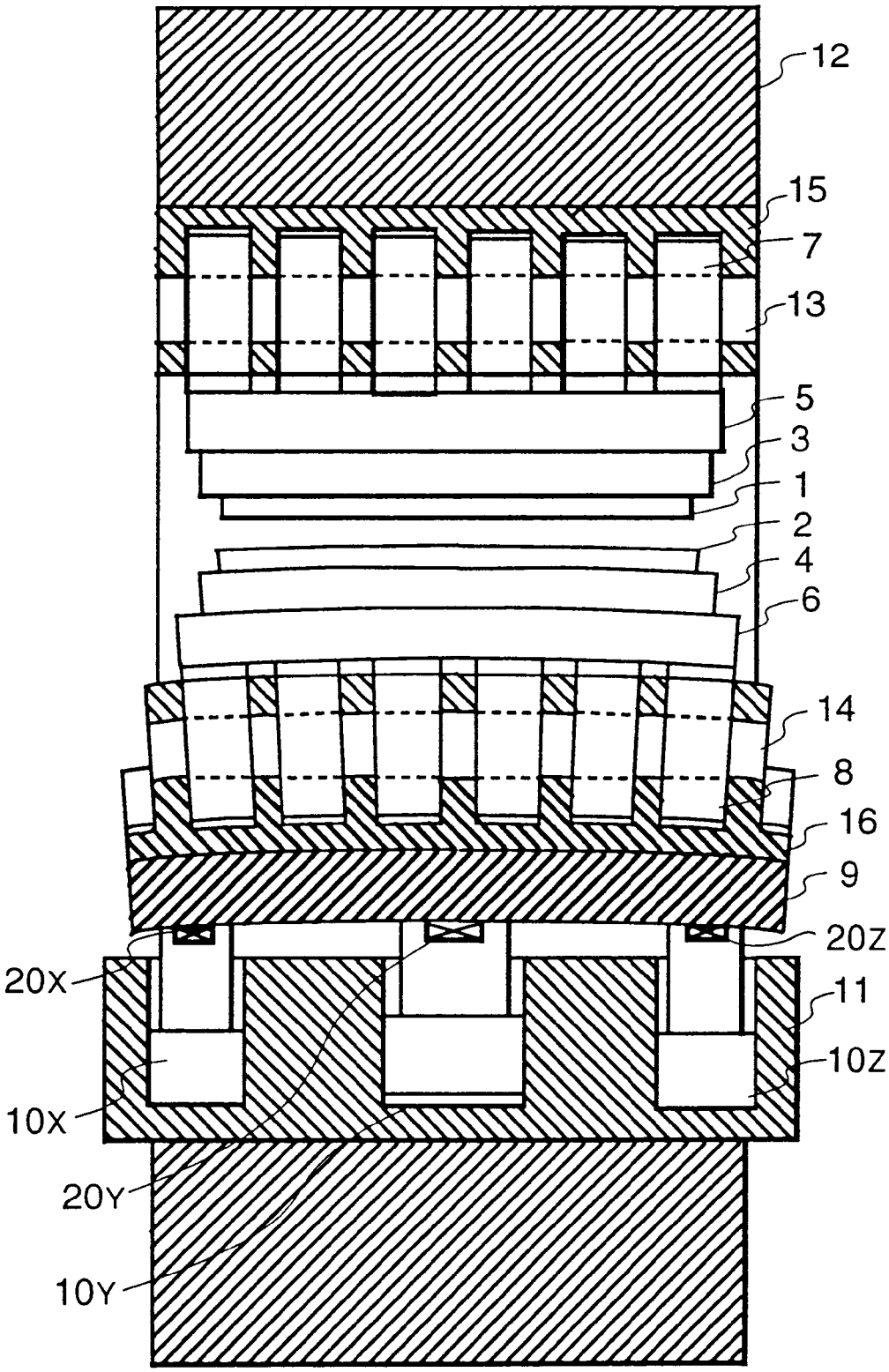
Figure 14:
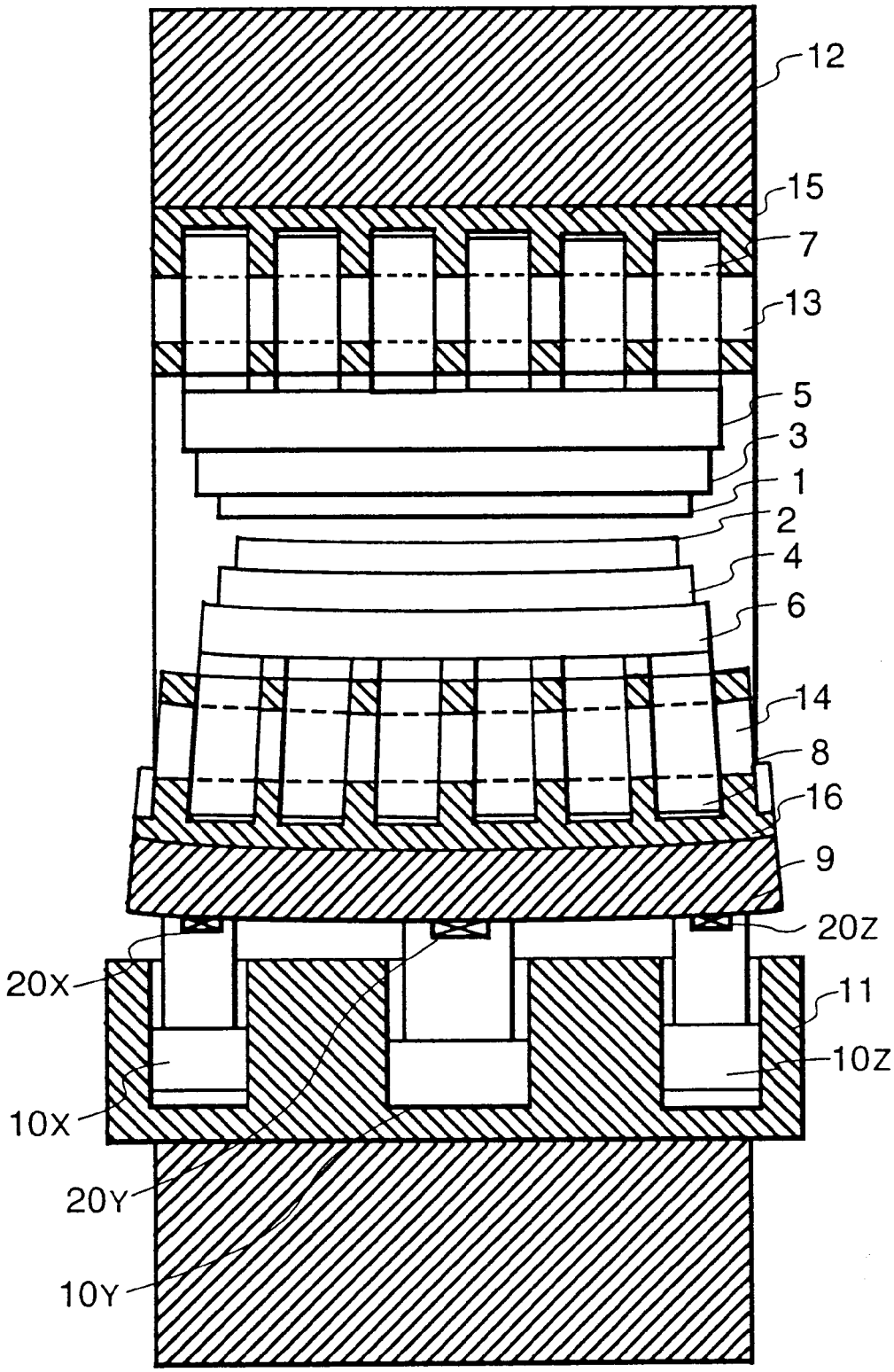

FIGS. 11A and 11B each are a sectional view of backing bearing of the invention;

FIG. 12 is a sectional view of a multi-roll rolling mill effecting levelling control in the present invention;

FIG. 13 is a sectional view of a multi-roll rolling mill effecting crown control in the invention; and FIG. 14 is a sectional view of a multi-roll rolling mill effecting crown control in the invention.

DESCRIPTION OF EMBODIMENTS OF THE INVENTION

The present invention retains advantages of the conventional sendzimir rolling mill and improves it to avoid the above-mentioned disadvantages, thereby providing a cluster type multi-roll rolling mill and rolling method which is easy to use and able to produce rolling products excellent in quality.

Figure 5:
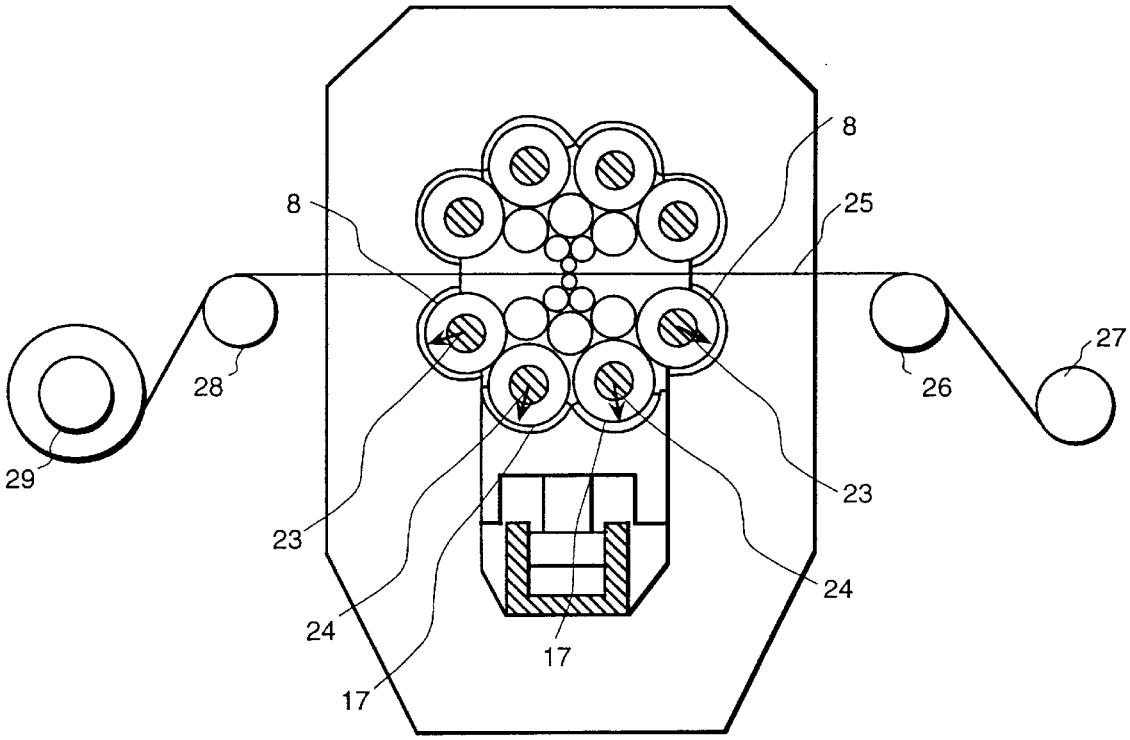
FIG. 5 is a front view of a rolling equipment using the cluster type multi-roll rolling mill shown in FIG. 1.

FIG. 5 shows a rolling mill equipment employing a cluster type 20-high rolling mill of an embodiment of the invention.

In this rolling mill equipment, a tension reel 29, a deflector roller 28, the cluster type 20-high rolling mill, a deflector roller 26 and a tension reel 27 are arranged in a mentioned order. For example, a strip 25 of a rolling material is coiled and decoiled by the tension reels 27 and 29, and rolled reversibly by the cluster type 20-high rolling mill in a normal direction and in a reverse direction.

Figure 1:
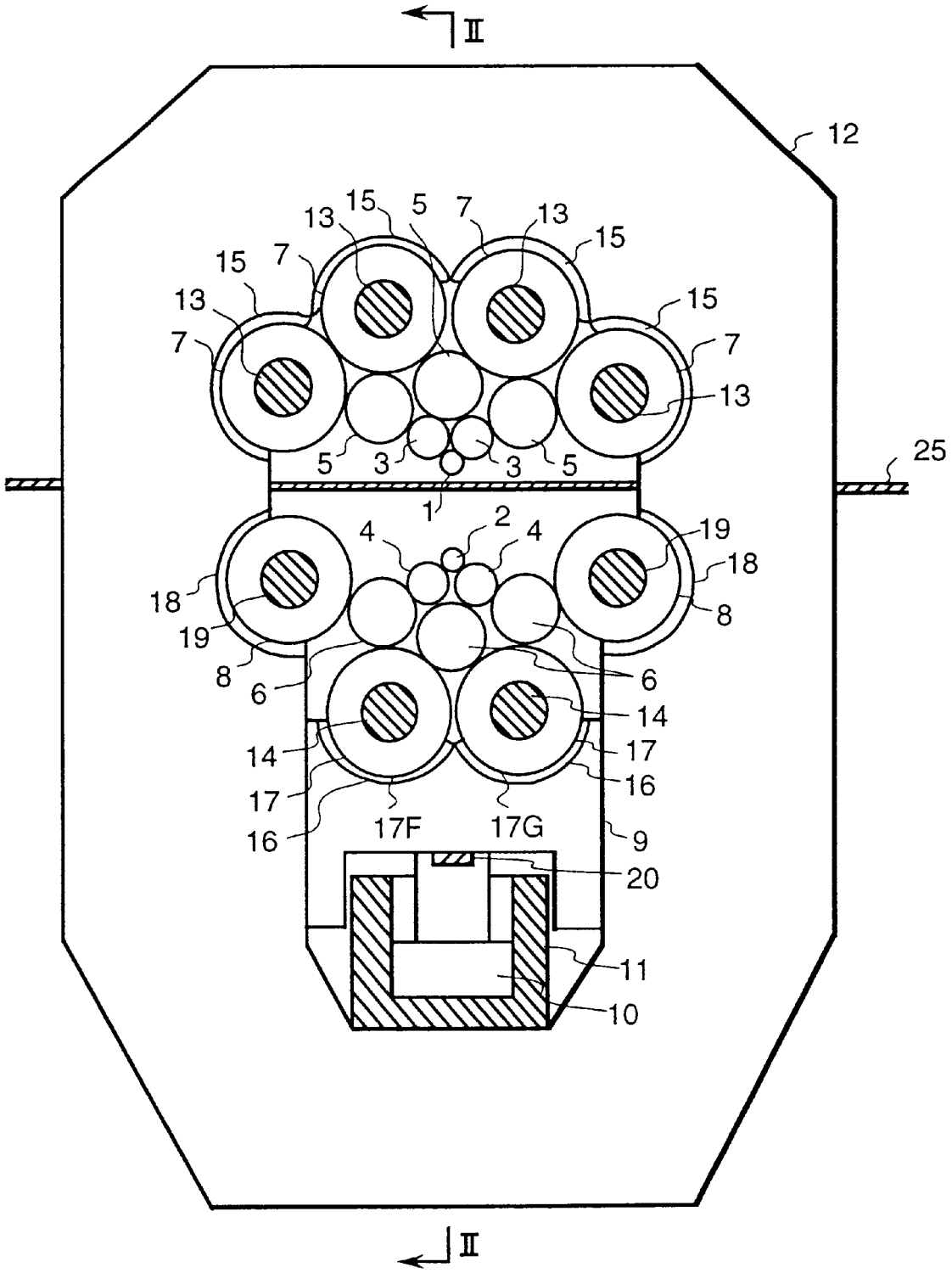
FIG. 1 is a front sectional view of a cluster type multi-roll rolling mill of one embodiment of the invention.

FIG. 1 shows the cluster type 20-high rolling mill which is an embodiment of the invention. In the multi-roll rolling mill, two central rows of backing bearings on the lower side of a threading path for a rolling strip are made movable up and down.

An upper work roll 1 and a lower work roll 2 are arranged on the upper and lower sides of a strip 25 of a rolling material, respectively. The upper work roll 1 is supported by two first intermediate rolls 3, and the lower work roll 2 is supported by two first intermediate rolls 4. The two first intermediate rolls 3 are supported by three second intermediate rolls 5, and the two first intermediate rolls 4 are supported by three second intermediate rolls 6.

Backing bearing groups 7 on the upper side of the strip 25 are mounted on 4 backing bearing shafts 13, respectively, and fixedly supported by a mono-block housing 12 through saddles 15. The three second intermediate rolls 5 are supported by the backing bearing groups 7.

Two outside backing bearing shafts 19 of 4 backing bearing shafts on the lower side of the strip 25 mount thereon backing bearing groups 8, the backing bearing groups 8 are fixedly supported by the housing 12 through saddles 18.

Further, two central backing bearing shafts 14 of the 4 backing bearing shafts 14 and 19 on the lower side mount thereon two backing bearing groups 17, and the backing bearing groups 17 are mounted on a vertically movable frame 9 through saddles 16.

The backing bearing groups 17 and 8 mounted on the two central backing bearing shafts 14 and the two outside backing bearing shafts 19 support the three second intermediate rolls 6.

The vertically movable frame 9 is supported through a hydraulic jack 10 and a block 11 so as to be slidable up and down.

In this embodiment, the two central backing bearing shafts 14 are mounted on the vertically movable frame 9 of a mono-block, however, they can be mounted on two vertically movable frames, respectively, and hydraulic jacks can be provided so as to individually move up and down the two movable frames.

Adjustment of driving the vertically movable frame 9 is effected by adjusting the hydraulic jack 10.

Here, torque for rolling is transmitted to the work rolls 1, 2 by spindles (not shown) through the second intermediate rolls 5, 6 and the first intermediate rolls 3, 4.

A load cell 20 for measuring rolling load can be provided at a hydraulic jack drive point which is a contact portion between the hydraulic jack 10 and the vertically movable frame 9.

Next, an operation is explained hereunder.

A work roll gap operation to adjust the gap between the upper and lower work rolls 1 and 2 is carried out as follows.

The hydraulic jack 10 is lowered to a lower limit position, whereby the vertically movable frame 9 and the backing bearing groups 17 mounted thereon are lowered. The descent of the backing bearing groups 17 lowers the three second intermediate rolls 6, the two first intermediate rolls 4 and the lower work roll 2, whereby a gap between the upper work roll 1 and the lower work roll 2 is provided and enlarged.

With this construction, a larger gap than in conventional machines can be provided. Concretely, the gap can be enlarged from the conventional small gap (about 6–8 mm) to about 100–150 mm. By provision of the enlarged gap, easiness of passing a rolling material through the gap is improved, whereby workability of rolling is drastically improved.

Further, in this embodiment, the backing bearing groups 8 which receive component force 23 of 50% of a rolling load applied to the rolling mill are fixed to the housing 12, as shown in FIG. 5.

With this construction, in the remaining backing bearing groups 17 receiving component force 24 of 45% of the rolling load, a direction of the load applied thereto is the same as an operational direction of the hydraulic jack which is downward, so that the vertically movable frame 9 is not bulged sideways, and the mill stiffness is not reduced. Further, since the sideways bulge does not occur, sliding resistance does not increase and hysteresis at the time of screw-down does not increase, either.

Figure 7:
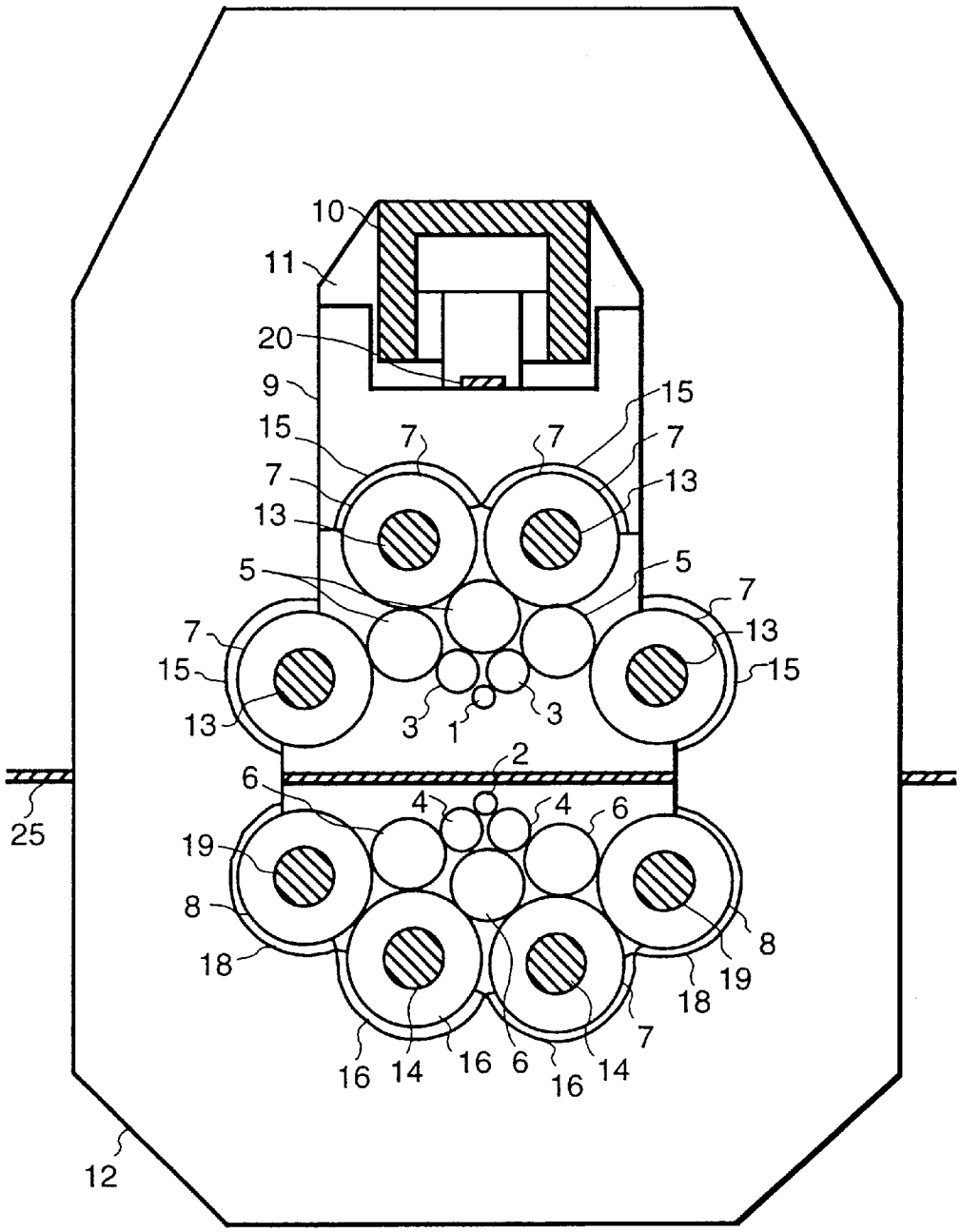
FIG. 7 is a front view of a multi-roll rolling mill of the embodiment of the invention.

Further, in this embodiment, the backing bearing shafts 14 on the lower side of the strip 25 are made movable up and down, however, such a construction can be applied to the backing bearing shafts 13 on the upper side of the strip, as shown in FIG. 7.

Further, such a construction can be applied to the backing bearing shafts on both of the upper and lower sides of the strip 25.

An ascent operation contrary to the descent operation is as follows.

First of all, the hydraulic jack 10 is ascended to an upper limit position, whereby the vertically movable frame 9 and the backing bearing groups 17 mounted thereon are ascended. The ascent of the backing bearing groups 17 raises the three second intermediate rolls 6, the two first intermediate rolls 4 and the lower work roll 2. The outside backing bearing group 8 on the lower side and the central backing bearing groups 17 on the lower side contact with each other.

Here, FIG. 1 shows a state that the vertically movable frame 9 is lowered, therefore, the outside backing bearing group 8 on the lower side and the central backing bearing groups 17 on the lower side are not in contact with each other.

Further, in this manner, since the central backing bearing groups 17 on the upper side are moveable up and down and the driving mechanism therefor is provided, various relevant values to the rolling load can be measured with the load cell 20 provided at the hydraulic jack drive point.

Next, an example is explained in which three vertical drive mechanisms for the central two backing bearing shafts 14 are provided at three positions in a roll-axial direction.

Figure 2:
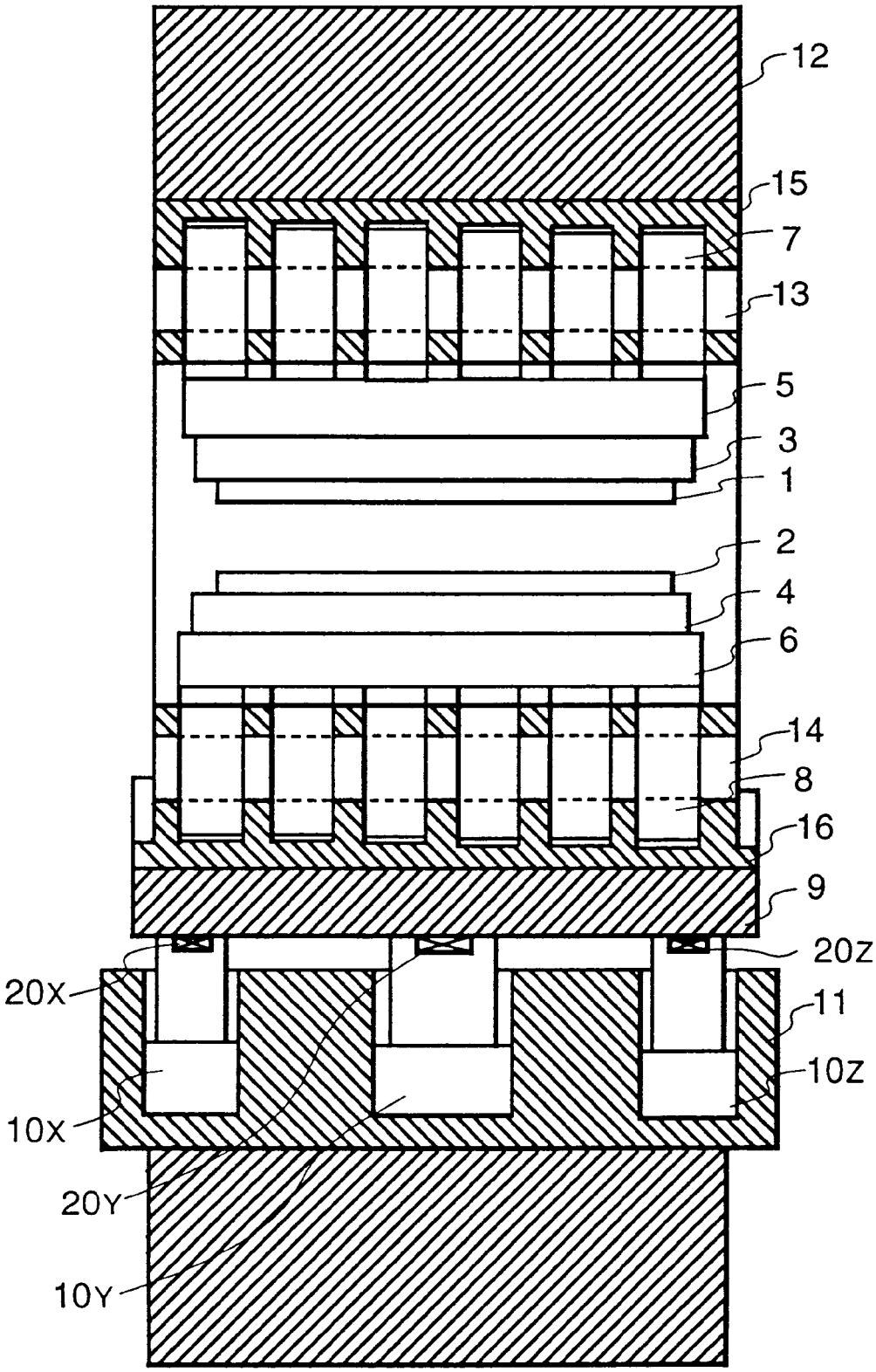
FIG. 2 is a sectional view taken along a line II—II of FIG. 1.

FIG. 2 shows a cluster type 20-high rolling mill of the example.

In FIG. 2, the three vertical drive mechanisms 10*x*, 10*y* and 10*z*, an example of which is a hydraulic jack, are arranged about both end portions and about a central portion between the both end portions, of the work roll in the roll-axial direction of the work rolls, the intermediate rolls, etc.

An example of a method of driving the mechanisms or hydraulic jacks 10*x*, 10*y*, 10*z* is such that the hydraulic jacks 10*x*, 10*y*, 10*z* are lowered to the same lower limit positions as each other, whereby the vertically movable frame 9, the backing bearing groups 17, the second intermediate rolls 6, the first intermediate rolls 4 and the lower work roll 4 are lowered in parallel with each other, thereby providing a large gap between the upper and lower work rolls 1 and 2.

In a rolling operation of a strip, the hydraulic jacks 10*x*, 10*y*, 10*z* each are raised by a same amount, whereby the lower work roll 2 rises keeping it in parallel and the strip is rolled between the upper and lower work rolls 1 and 2.

In a levelling operation, rising amounts of the hydraulic jacks 10*x*, 10*y*, 10*z* are controlled to be linear, the lower work roll 2 is raised as it is inclined, and the strip is rolled between the upper and lower work rolls 1 and 2.

In a strip crown/shape control, rising amounts of the hydraulic jacks 10*x*, 10*y*, 10*z* are controlled to be concavo-convex, and concavo-convex bending is imparted to the lower work roll 2, thereby effecting a strip crown control to be concavo-convex.

Therefore, the strip crown/shape controllability increases, whereby the shape quality of the rolled plate can be increased. Further, stable acceleration is possible and productibility rises.

Further, it is possible to provide the rolling mill with a bending function of effecting strip crown/shape control by providing conventional saddles with eccentrically supporting hearings and changing the eccentricity.

Further, it is possible to provide the saddle with a double eccentricity function and use it for adjusting an upper pass line.

Next, with the cluster type 20-high rolling mill in which the central two rows 14 of backing bearing shafts on the lower side in FIG. 2 are made movable up and down, an example is explained in which the central two rows of backing bearing shafts 13 on the upper side, which central two rows are on reverse side to the central two rows 14 made movable up and down, are made in split type.

By dividing the shaft 13, it becomes possible to increase the above-mentioned each eccentricity, an control amount in the strip crown/shape control increases.

Figure 3:
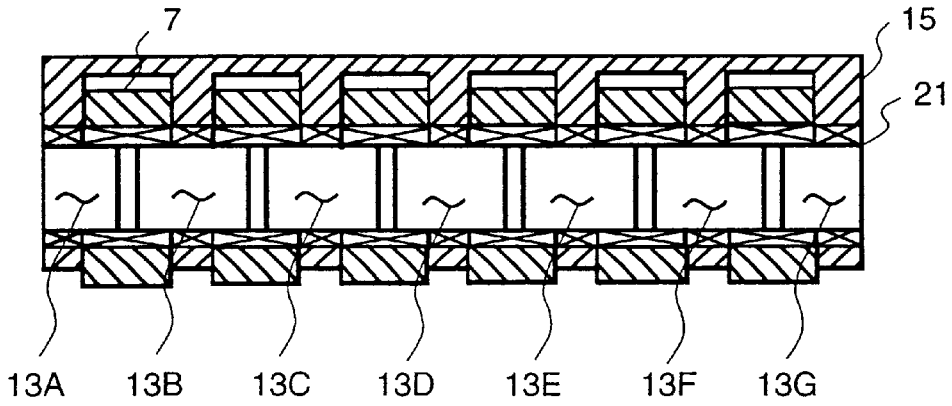
FIG. 3 is a sectional view of a split type backing bearing shaft of a cluster type multi-roll rolling mill.
Figure 4:
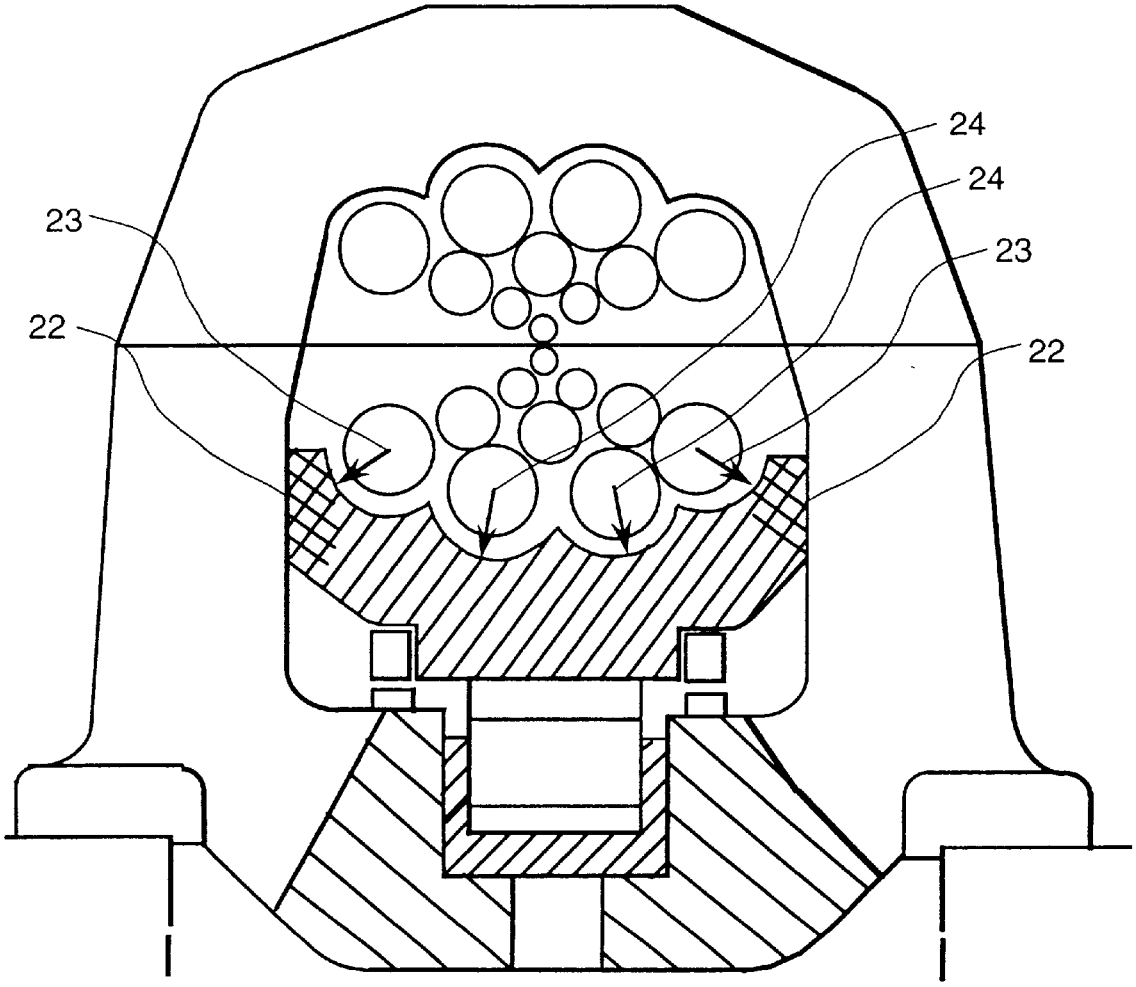
FIG. 4 is a front sectional view of a multi-roll rolling mill of type in which all backing bearings of a lower portion are driven.

FIG. 3 shows an embodiment of the split type shaft 13. In this embodiment, the split type shaft 13 is divided into 7 sections 13A to 13G, each of which is supported by a saddle 15 through an eccentric bearing 21.

In this manner, with the cluster type 20-high rolling mill in which the central two rows of backing bearing shafts on the lower side are made movable up and down, the central two rows of backing bearing shafts 13 on the upper side, which central two rows are on reverse side to the central two rows 14 made movable up and down, are made in split type, whereby eccentricity of each shaft can be increased, a control amount of the strip crown/shape control increases, the precision in the strip crown/shape control can be improved. An amount of eccentricity is about 4–10 mm, preferably about 8.5 mm.

Further, by providing load cells 20*z*, 20*y*, 20*z* at the drive points of the hydraulic jacks 10*x*, 10*y*, 10*z*, values relevant to the rolling load can be measured precisely.

In a case where the three drive mechanisms are provided in the roll-axial direction of the work roll, the housing 12 is made of a mono-block, and two central backing bearing groups 17F, 17G of the 4 backing bearing groups on the lower side are mounted on the vertically movable frame 9 which is movable up and down, and made movable up and down by three hydraulic jacks 10*x*, 10*y*, 10*z*.

Control of the three hydraulic jacks 10*x*, 10*y*, 10*z* is as follows.

Assuming that control amounts of the three hydraulic jacks 10*x*, 10*y*, 10*z* be X, Y, Z, respectively and any value be δ, the following control amounts can be taken:

(1) Large work roll gap operation and screw-down control: X, Y, Z simultaneous parallel screw-down, $X=Y=Z=\pm\delta$.

(2) Leveling: when $Y=0$ and $X=+\delta$, $Z=-\delta$; and when $Y=0$ and $X=-\delta$, $Z=+\delta$ (shown in FIG. 12).

(3) Crown control: when $Y=0$ and $X=+\delta$, $Z=+\delta$ (shown in FIG. 14; and when $Y=0$ and $X=-\delta$, $Z=-\delta$ (shown in FIG. 13).

As shown in FIG. 12, X and Z can be controlled by the same amount in a revere direction to each other, with Y being fixed, and the leveling can be easily effected. As shown in FIGS. 13 and 14, X and Z can be controlled by the same amount in a same direction, with Y at a central portion being fixed, whereby the ability of the crown control is raised greatly.

That is, by these three hydraulic jacks 10*x*, 10*y*, 10*z*, in particular, expansion of the gap between the upper and lower work rolls, screw-down control, leveling, and secondary crown control become possible.

In this case, if three hydraulic jacks or more are employed without limiting to the three hydraulic jacks, expansion of the gap between the upper and lower work rolls, screw-down control, leveling, and secondary crown control are possible.

However, even if two or less hydraulic jacks are employed, in the above-mentioned multi-roll rolling mill, an excellent mill stiffness can be provided, whereby it is possible to improve gauge accuracy in thickness of a rolling material, and a roll gap between the upper and lower work rolls can be enlarged, whereby it is possible to make it easy to thread the rolling material through the roll gap.

By such three hydraulic jacks, the conventional AS-U system is sufficient if only local strip shape control is carried out, and since the screw-down control is unnecessary, it is unnecessary to make the inner shaft into a mono-block, but it can be divided every bearing, so that it is unnecessary to restrict the control ability.

Figure 8:
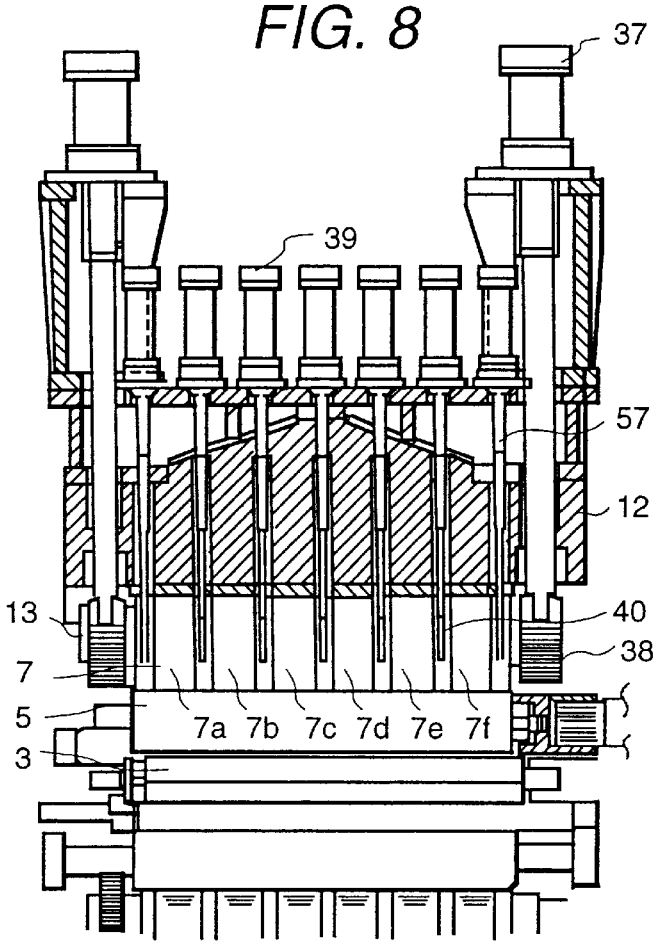
FIG. 8 is a sectional view showing the embodiment of the invention.

FIG. 8 is a sectional view of a housing 12 of which a section taken by a plane connecting the upper and lower work rolls is shown, and a center section of roll group. In FIG. 8, an arrangement of a screw-down hydraulic cylinder 37 and AS-U system 39 for effecting position adjustment of each backing bearing is shown.

In this figure, two central groups of the backing bearing groups 7 are shown, wherein screw-down racks 38 are provided at both ends of backing shaft 13, screw-down control is effected by screw-down cylinders 37 and a screw-down eccentricity mechanism shown in FIGS. 11A and 11B to adjust an upper pass line.

The AS-U systems 39 are arranged between a plurality of backing bearings 7*a* to 7*f* which are divided along the axes of the backing bearing groups 7, and adjust radial position of each of the backing bearings 7*a* to 7*f*.

Figure 9:
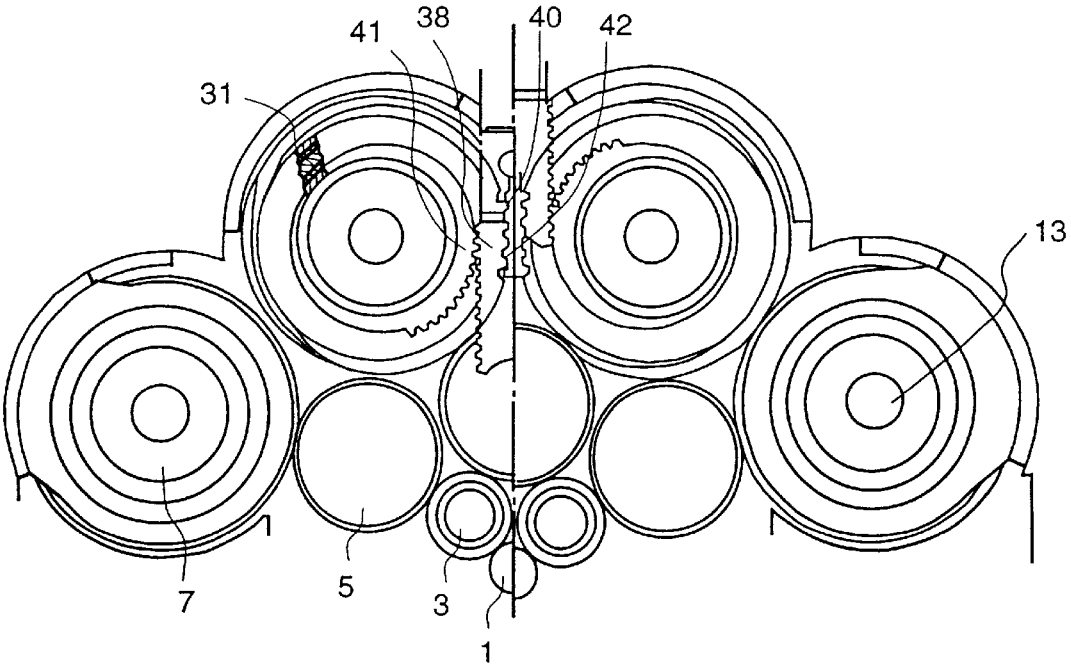
FIG. 9 is a sectional view, viewed from an operation side, of upper roll group of a multi-roll rolling mill of the embodiment of the invention.

FIG. 9 is a view, taken from a mill operational side and showing upper half rolls including 4 shafts 13 of the backing bearing groups 7. FIG. 9 shows meshing condition between a screw-down gear 41 of the backing bearing, a AS-U gear 42 and respective racks 38, 40. Backing bearings as shown in FIGS. 11A and 11B and having an eccentric ring 31 for AS-U system are used for the two central shafts.

Figure 10:
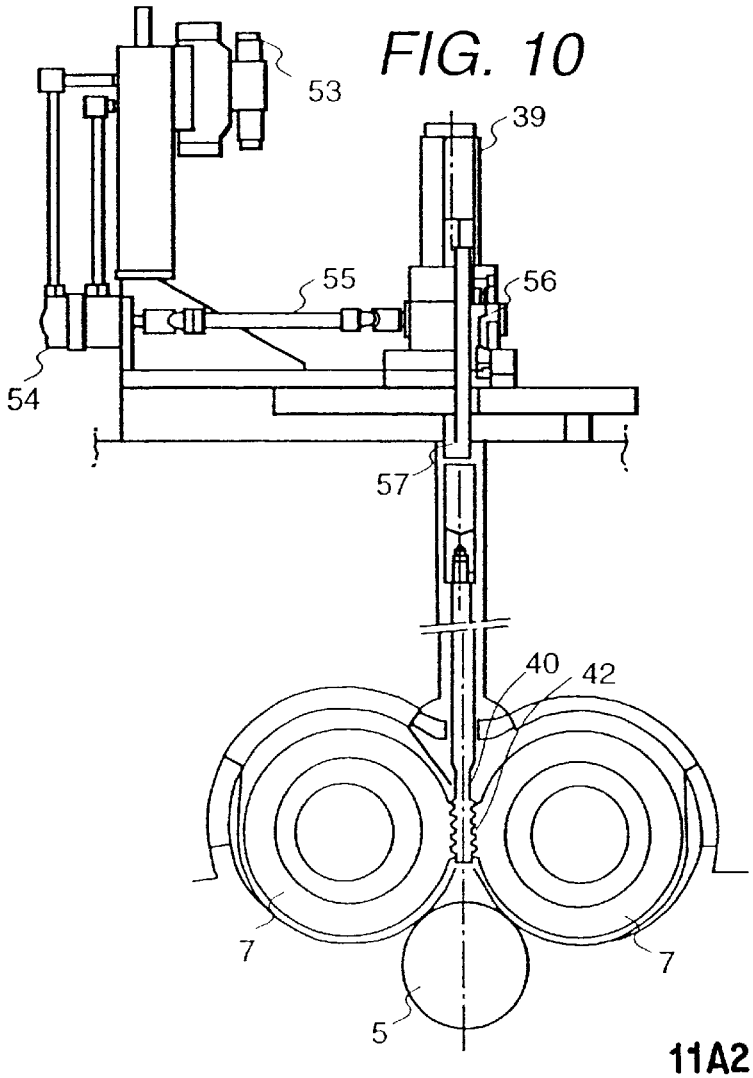
FIG. 10 is a view showing AS-U system of a multi-roll rolling mill of the embodiment of the invention.
Figure 10:
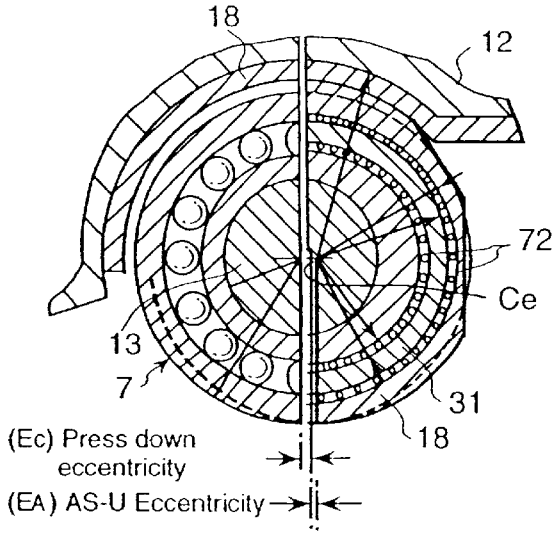

FIG. 10 shows an operational condition of the rack 40 for AS-U system shown in FIG. 9.

The AS-U system rack 40 descends or ascends by rotating a connecting rod 55 directly connected to an AS-U up-and-down apparatus 39 by a hydraulic motor 54 which is operated with an electromagnetic switching valve 53. The connecting rod 55 rotates a worm within the AS-U up-and-down apparatus 39 and then rotates a worm gear 56 meshed with the worm. A screw is provided inside the worm gear 56, rotation of the screw descends or ascends the AS-U rod 57 meshed with the screw, and the rod 57 descends or ascends AS-U rod 40 directly connected to the AS-U rod 57, thereby acting to impart crown to the backing bearing shaft 13 described later.

In stead of the above-mentioned means of worm, worm gear and screw, there also is a construction in which the AS-U rod 57 is directly operated by a hydraulic cylinder.

FIGS. 11A and 11B show a construction of the backing bearing 7 provided with the AS-U system 39. The backing bearing 7 has a mechanism for rotating the eccentric ring 31 about a center thereof which is eccentric to a center Ce of the backing bearing shaft 13 by an eccentric amount EA (AS-U eccentric amount). AS-U gear 42 not shown in this figure is mounted on the AS-U eccentric ring 31, Rotation of this gear 42 rotates the eccentric ring 31. By changing the AS-U eccentric amount at each saddle position, a crown is imparted to the backing bearing shaft 13, and this adjusts axis deflection of the work roll 1, whereby strip crown/shape control of strip 25 is effected.

The AS-U eccentric ring 31 is supported by the shaft 13 and the saddle 18 through a needle bearing 72 for making it easy to operation during rolling by the AS-U system 39 and for the purpose of reduction of rotation loss.

Figure 6:
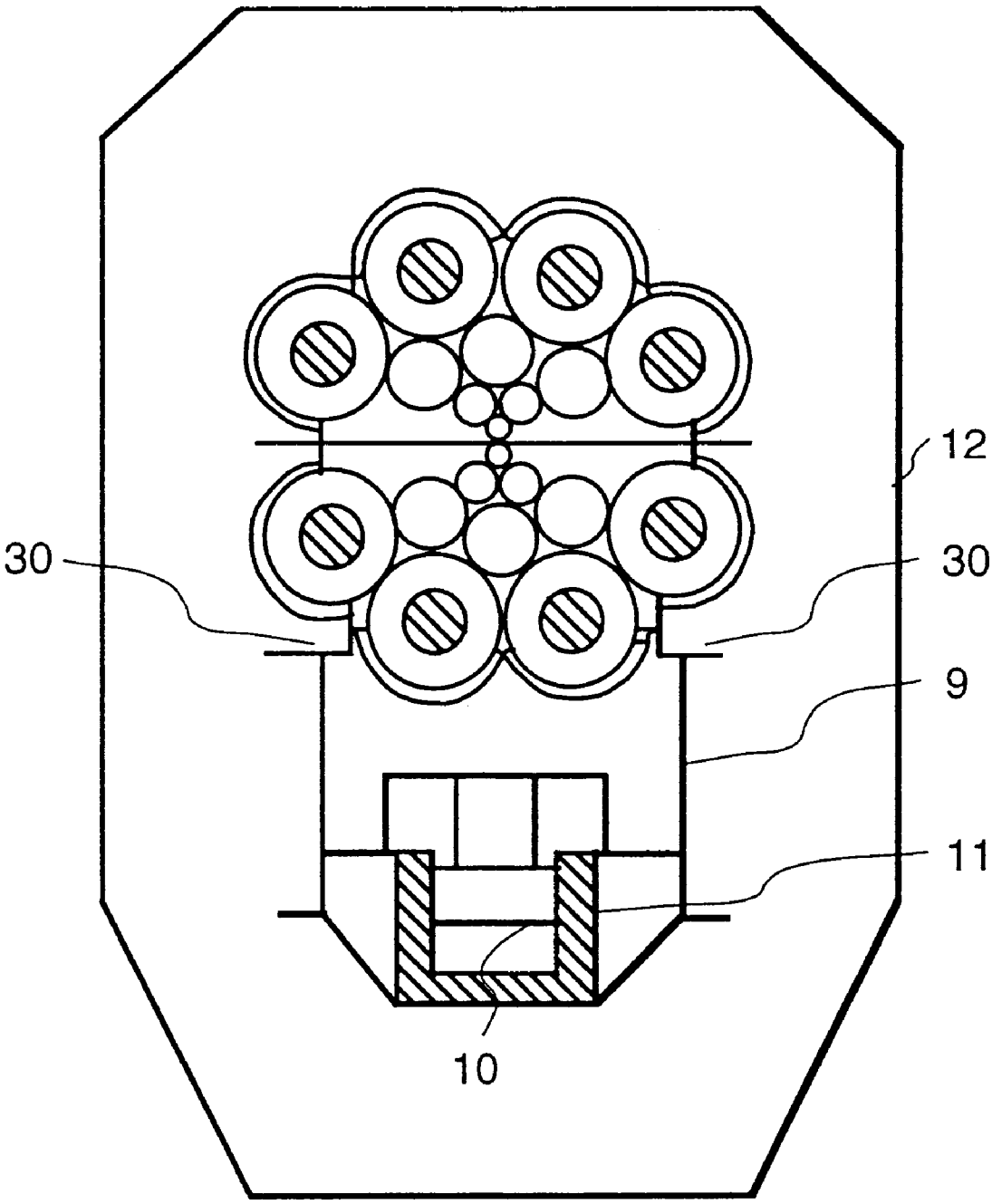
FIG. 6 is a front sectional view of a cluster type multi-roll rolling mill of another embodiment of the invention.

Next, an embodiment of the rolling mill provided with mechanical stoppers is explained, referring to FIG.6.

FIG. 6 shows the condition that the central backing bearing groups are raised by the vertical drive mechanism, wherein the outside backing bearing groups 8 on the lower side and the central backing bearing groups 17 on the lower side are contacted with each other.

The embodiment of FIG. 6 is a rolling mill in which the mechanical stoppers 30 are provided in the housing 12. Output of the hydraulic jack 10 is set to one more than the rolling load, thereby re-loading.

Further, when rolls are changed or strip is threaded, the vertically movable frame 9 is lowered by the hydraulic jack 10, and it is possible to enlarge a gap between the work rolls. Here, as the screw-down mechanism used for rolling, a conventional backing-bearing-shaft saddle-eccentricity screw-down mechanism is used.

In this embodiment, since pre-loading is effected, mill stiffness reduction by a volume of liquid held in the hydraulic jack can be avoided.

As mentioned above, a roll gap between the upper and lower work rolls can be made larger, screw-down is directly driven and rolling load can be easily detected.

Therefore, a construction of the backing bearing can be simplified.

Further, since the rolling mill is made of a mono-block housing, it is unnecessary to provide an outer housing outside the housing, the size can be made small and the equipment also can be small-sized.

According to the present invention, it is possible to provide a cluster type multi-roll rolling mill which is excellent in mill stiffness, able to raise thickness precision of a rolling material, and able to increase a gap between upper and lower work rolls thereby making it easy to thread the rolling material through the gap, and a rolling method.

What is claimed is:

1. A cluster type multi-roll rolling mill with 20 rolls, comprising:

a mono-block housing accommodating therein said rolls;

4 backing bearing shafts on each of upper and lower sides of a traveling path of a rolling strip, said 4 backing bearing shafts each having a plurality of backing bearings axially arranged thereon and supporting five intermediate rolls and a work roll, said 4 backing bearing shafts on at least one side of said upper and lower sides consisting of two outside backing bearing shafts and two central backing bearing shafts, said two outside backing bearing shafts each being fixed to said housing through a saddle and said two central backing bearing shafts each being vertically movable;

a movable frame provided to be movable in said mono-block housing in a vertical direction and supporting said two central backing bearing shafts through a saddle;

a drive mechanism of a hydraulic type for moving vertically said movable frame; and a coupling mechanism for coupling said frame and said mono-block housing with hydraulic force while allowing said rolls supported by said movable frame to be free of said hydraulic force, said coupling mechanism comprising a mechanical stopper of said mono-block housing and said driving mechanism, with hydraulic pressure more than a rolling load being applied on said frame.

2. A cluster type multi-roll rolling mill according to claim 1, wherein said mechanical stopper is a part of said mono-block housing, said movable frame being in tight contact with said part of mono-block housing by the hydraulic force during rolling.

3. A cluster type multi-roll rolling mill according to claim 1, wherein a screw-down mechanism is provided which is a backing-bearing-shaft saddle-eccentricity screw-down mechanism operable to apply crown control adjusting forces to rollers supported on the central backing bearing shafts.

4. A cluster type multi-roll rolling mill according to claim 2, wherein a screw-down mechanism is provided which is a backing-bearing-shaft saddle-eccentricity screw-down mechanism operable to apply crown control adjusting forces to rollers supported on the central backing bearing shafts.

* * * * *